US005893807A

United States Patent [19]

Aikens

[11] Patent Number: 5,893,807

[45] Date of Patent: Apr. 13, 1999

[54] PRACTICE TARGET FOR BALL GAMES

[76] Inventor: Robert S. Aikens, 4111 Hamilton Ave., Baltimore, Md. 21206

[21] Appl. No.: 08/927,725

[22] Filed: Sep. 11, 1997

[51] Int. Cl.[6] ..... A63B 63/00

[52] U.S. Cl. ..... 473/422; 473/447

[58] Field of Search ..... 273/400; 473/422, 473/438, 439, 446, 447, 448, 479

[56] References Cited

U.S. PATENT DOCUMENTS

| | | | |
|---|---|---|---|
| 3,820,787 | 6/1974 | Heinbigner | 473/439 |
| 3,823,939 | 7/1974 | Dottorff | 473/439 |
| 4,936,578 | 6/1990 | Hudson, Sr. | 473/439 |
| 5,738,600 | 4/1998 | Fouts et al. | 473/448 |
| 5,785,616 | 7/1998 | Dodge | 473/479 |
| 5,800,290 | 9/1998 | Barry | 473/438 |

*Primary Examiner*—William H. Grieb

[57] ABSTRACT

PRACTICE TARGET FOR BALL GAMES is a means to improve scoring or throwing skills in games utilizing a ball or propelled device including but not limited to lacrosse, baseball football, hockey and soccer. The system as described comprises a metal ring encircled by a colored material which is amenable to being positioned at any desired location on a support. This support could be either a goal-post for any of the games mentioned earlier or an eassily assembled structure that could be provided along with the practice target ring. The size of the ring would be proportional to the size of the porpelling device used in the game being practiced. The metal ring is attached to a metal plate of variable length which is in turn provided with a bracket for attachment to a vertical or horizontal support.

1 Claim, 1 Drawing Sheet

PRACTICE TARGET FOR BALL GAMES

BACKGROUND OF THE INVENTION

1. Field of Invention

The present invention as described relates to a device which comprises a metal ring attached to a plate of variable length. Which in turn is attached with a bracket to a horizontal or vertical support and is amenable to being positioned at any desired location along the support. This support could be either a goal-post for games with goals or an eassily assembled structure that could be provided along with the practice target device.

2. Description of Related Art

Adjustable and demountable practice targets for ball games devices are known in the art. The known devices generally comprise a bracket secured to a standard or a framework usually provided in conjunction with the device. Although these known devices are usually made adjustable and in some instances can be disassembled for portability they are nevertheless limited in their applcation to the paticular purpose for which they were designed.

SUMMARY OF THE INVENTION

The invention was primarily designed to be a low cost portable target for games that utilize a goal. The device is designed to be easily attached to a goal-post or support so the angle of the target will be perpendicular to the trajectory of the propelling device. Netting can be provided with the device to allow for ball control and to catch any ball entering said device. The metal ring is encircled by a rubber colorized material to make the parimeter of the device more visable and will enhance the concentration of the user. The device improves on practice devices of prior art by being able to be attached to a goal post for real-time practice and by using a construction configuration that is amenable to being used many types of standard supports.

DETAILED DESCRIPTION OF THE INVENTION

Figure 1:
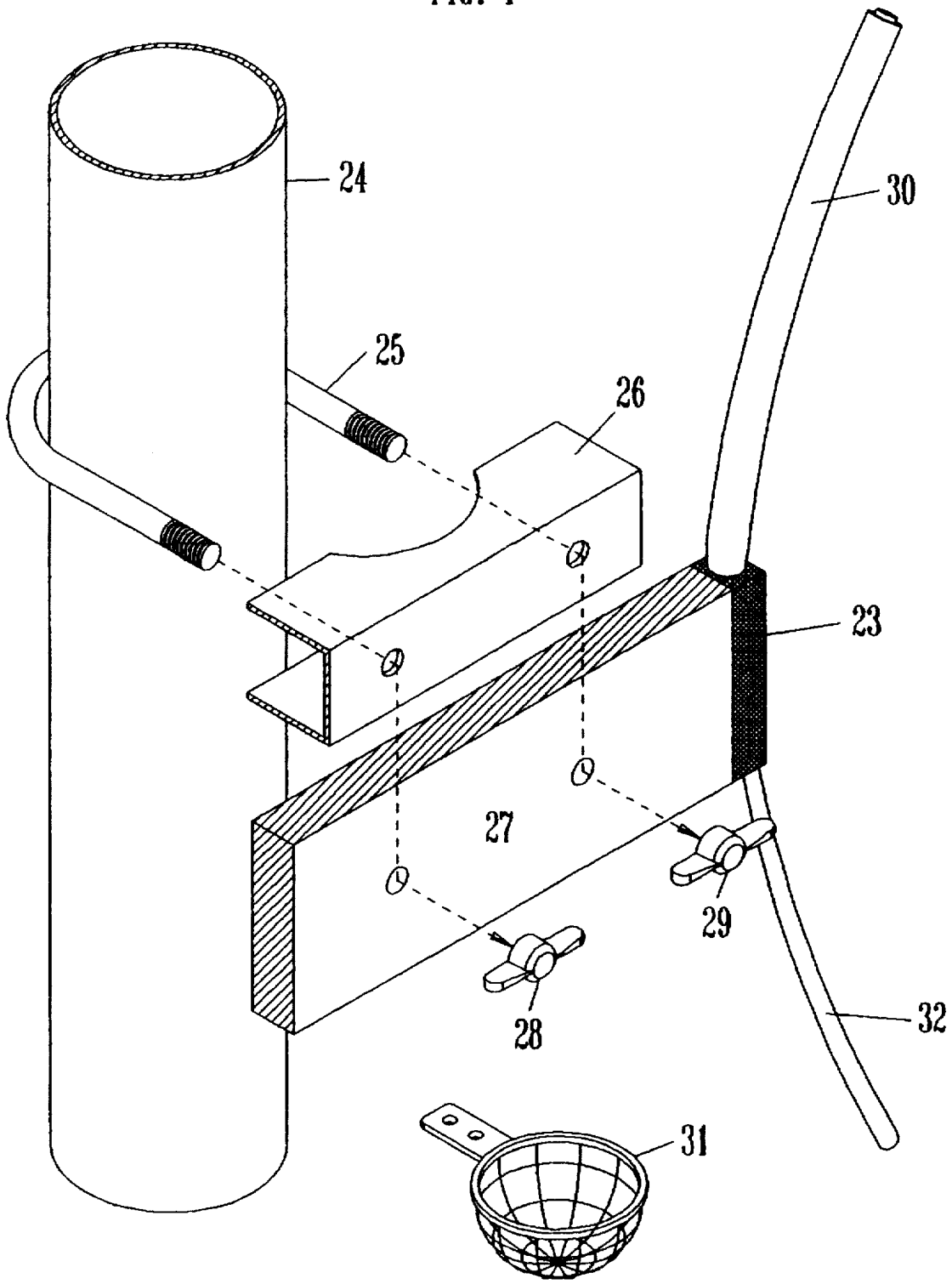
FIG. 1 is an isometric exploded view showing the relationship of assembly for the various parts of the invention.

FIG. 1 illustrates a loop arrangement for the Practice target device 23. The metal ring 32 and supporting metal plate 27 are welded together so the metal plate 27 extends outwordly at one point along the circumference of the metal ring 32. Bracket 26 is secured to the standard 24 and metal plate 27 by means of a threaded metal u-bolt 25 which will extend through bracket 26 and metal plate 27 where it will receive wingnuts 28,29 or the like to simultaneously secure both bracket 26, metal plate 27 with metal ring 32 to the standard 24. The bracket 26 could also be attached to metal plate 27 by welding or brazing. The metal ring 32 is encircled by rubber tubing 30 which extends around from top edge of metal plate 27 to the bottom edge of the metal plate 27. A flexible bag 31 having its open mouth margin secured around said rubber tubing 30 by any conventional means, such as being tied or some form of hooks.

What I claim as my invention is:

1. A portable training and practice target device comprising:

(a) First support clamp adapted to mount said practice target device at any desired location on any standard or goal-post provided. Said clamp comprising a daul u-shaped base with u-bolt and wingnuts for attachment to a metal arm plate and said standard;

(b) Said practice target device comprising a loop with said arm plate extending outwordly at one point along its circumference;

(c) Said arm plate with a pair of holes drilled for u-bolt connection to resiliently secure said first clamp to said arm plate and said standard or goal-post;

(d) A flexible bag, the mouth of said bag being secured around a ring to allow for a propelling device to enter said bag through said ring;

(e) A rubber tubbing which extends around said loop for enhancing users concentration.

* * * * *